United States Patent [19]

Nelson

[11] 4,335,286

[45] Jun. 15, 1982

[54] WATERPROOF ELECTRICAL SWITCH

[76] Inventor: Gunnar Nelson, P.O. Box 2847, Marathon Shores, Fla. 33052

[21] Appl. No.: 124,067

[22] Filed: Feb. 25, 1980

[51] Int. Cl.[3] ..... H01H 9/04

[52] U.S. Cl. ..... 200/302; 200/325; 200/332; 200/51.09; 200/44

[58] Field of Search ..... 200/302, 323, 325, 327, 200/330, 331, 332, 50 B, 50 R, 51.09, 42 T, 44

[56] References Cited

U.S. PATENT DOCUMENTS

| | | | |
|---|---|---|---|
| 1,924,691 | 8/1933 | Lofgrien | 200/50 B |
| 1,934,024 | 11/1933 | Anderson | 200/50 B |
| 1,947,634 | 2/1934 | Anderson | 200/50 B |
| 1,971,990 | 8/1934 | Reynolds et al. | 200/50 B |
| 2,015,543 | 9/1935 | Bissell | 200/50 B |
| 2,241,828 | 5/1941 | Reynolds | 200/50 B |
| 2,420,865 | 5/1947 | Conlan | 200/50 B |
| 2,470,944 | 5/1949 | Parish | 200/50 B |
| 3,997,750 | 12/1976 | Glazer | 200/302 |

FOREIGN PATENT DOCUMENTS

| | | | |
|---|---|---|---|
| 1099129 | 8/1955 | France | 200/50 B |

*Primary Examiner*—Willis Little

*Attorney, Agent, or Firm*—Sheldon H. Parker

[57] ABSTRACT

A waterproof electrical switch or circuit breaker is precluded from being set in the ON position, except after a plug has been inserted into the receptacle and a safety-interlocking mechanism has been activated. Withdrawal of the plug from the receptacle is precluded, except when the circuit breaker is in the OFF position.

11 Claims, 7 Drawing Figures

WATERPROOF ELECTRICAL SWITCH

BACKGROUND OF THE INVENTION

1. Summary of the Invention

This invention relates to a watertight receptacle in which the electrical contacts of the receptacle are not energized when exposed to human touch and in which the electrical plug cannot be withdrawn or entered while the electrical contacts are energized.

2. Description of the Prior Art

Watertight electric outlet receptacles have been in use at shore side and ship board installations for many years. Essentially, one prime application involves refrigerated containers being transported on land with the refrigeration being powered by the transporter. Once at dock side or in place on board ship, the refrigeration unit receives its power from an electrical installation which quite obviously must be watertight due to the wet environment and the associated corrosive problem. Experience has shown that the electrical receptacles, which are typically 220 and 440 volt installations, must be not only protected from the environment but also must not have exposed electrical contacts which can be accidentally or inadvertently contacted by a human.

While there have been many approaches to the problem, there is still a need in the market place for a device which is extremely simple in construction, uses few parts and is low in cost.

In attempting to achieve a design which would overcome these problems one cannot simply look to the extensive electrical receptacle art relating to, by way of example explosion proof electrical receptacles, since the basic criteria for explosion proof receptacles and waterproof receptacles are basically incompatible. Explosion proof receptacles must provide means for gas, which seeps into the receptacle region in which sparking occurs, to be released from the receptacle in the event of an internal explosion due to the spark. This must be done at a rate which is slow enough for the gas to be cool before hitting the atmosphere and therefore avoiding ignition of ambient gas. A watertight receptacle would preclude gas from being released at a regulated rate since the container would have to be totally sealed, but would not entirely preclude entry of gas to the unit due to the far greater permeability of gas than water. In the event of a spark induced explosion, the restricted travel of the gas would either cause the container to blow apart or else, upon rupturing the seal, cause hot gases to be released with the danger of a major explosion occuring. By way of contrast, the controlled fluid egress-ingress provided in explosion proof receptacles would permit moisture and water to enter the receptacle causing corrosion and destroying the value of the device.

Of even greater consequence than the functional difference between the explosion proof and watertight seals, is the difference between the regions which must be sealed. In the waterproof units corrosion must be prevented with respect to all components whereas in explosion proof units, the restricted flow seal must be limited to a confined region around the spark producing switch. Thus, not only is the mode of sealing different, but all of the critical regions to be sealed are different.

For these reasons, attempts to adapt explosion proof receptacles to waterproof applications have met with little success. Typically a specific design for watertight units is required so that all elements can be totally sealed which goes beyond the mere replacement of waterproof seals for restricted flow gaskets.

Looking to the explosion proof receptacle type of prior art one finds that devices have been known for an extensive period of time which can provide some of the currently desired functions. For example, U.S. Pat. No. 1,947,634 issued in 1934 broadly disclosed the idea of locking a plug to a receptacle and controlling the activation of power through a plunger type lever. In 1935 U.S. Pat. No. 2,015,543 disclosed a safety locking mechanism in which a plug cannot be either inserted or removed from a receptacle unless the power control switch was in the off position. Switch boxes or receptacles which have pluging means which can be locked in place so that power is supplied only when the plug is properly inserted in the receptacle are commonly found in the prior art. As for example evidenced in U.S. Pat. No. 1,934,024 issued 1933 U.S. Pat. No. 1,971,990 issued in 1934, U.S. Pat. No. 1,731,893 issued in 1929, have not proven to be interchangable or inter-adaptable and a device of the desired simplicity and safety characteristics has not been developed, not withstanding the extensive period in which there has been a need for a reliable, safe, watertight unit which cannot be activated unless a plug is properly in place. U.S. Pat. Nos. 2,420,865 (1949) and 1,947,634 (1934) are illustrative of the time period under discussion.

BRIEF DESCRIPTION OF THE DRAWINGS

The objects and advantages of the invention will become apparent to those skilled in the art, from the following detailed description of a preferred embodiment of the invention when read in conjunction with the accompanying drawings, wherein.

DETAILED DESCRIPTION OF THE INVENTION

It has now been found that a device having a totally waterproof enclosure and employing few movable parts, that is, an extremely simple and inexpensive mechanism, is provided by the design of the instant invention.

Figure 1:
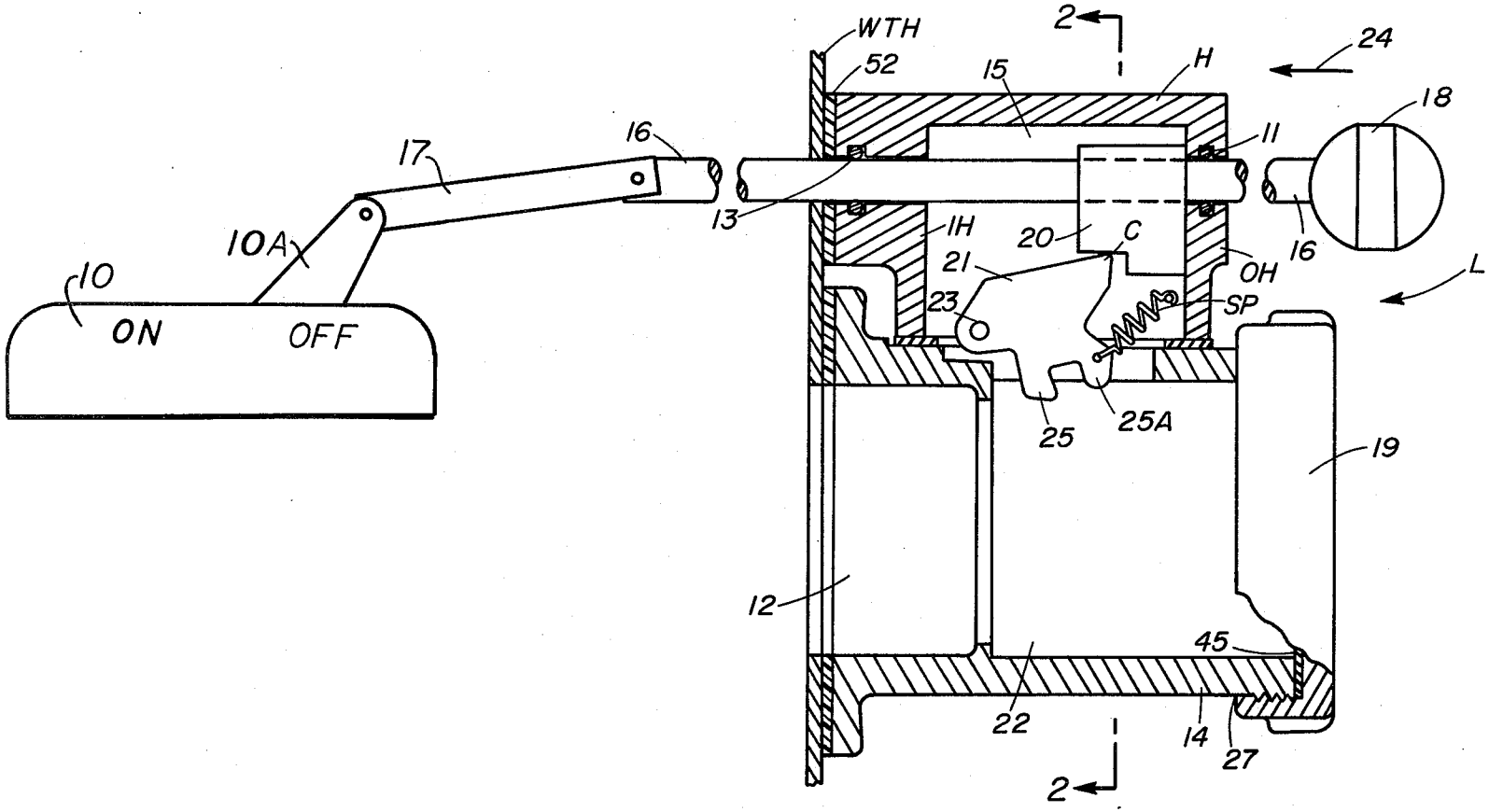
FIG. 1 is a fragmentary side view, partly in section, of a preferred embodiment, showing the plug out of the receptacle and the circuit breaker in the OFF condition.

FIG. 1 illustrates the receptacle R and the manual activating lever or knob 18 in combination with the waterproof housings. All internal circuit breakers, electrical leads, connecting rods, etc. are enclosed in the housings.

Manual activating arm or knob 18 is located in the top portion of the receptacle R. The knob 18 can be of any form of the "push-pull" type knobs as known in the prior art. Connected to the knob 18 is the shaft 16 which passes through the safety lock housing H. The shaft 16 can be connected to the knob 18 by whatever means desired for manufacture.

The safety lock housing H includes inner and outer waterproof walls, IH and OH. At the points where the shaft 16 passes through the safety lock housing H, "O"-ring seals 11 and 13 are used to maintain the watertight integrity of the safety lock housing H. The shaft 16 extends through the safety lock housing H and is connected to the connecting rod 17, which in turn is connected to the on-off circuit breaker lever 10A.

Within the safety lock housing H is the locking member chamber 15. The shaft 16 carries a lock member 20, which is fixed to the shaft 16 in a stationary position. Below the lock member 20 is a rotating lock member 21 which has latch members 25 and 25A which can extend downward into the plug housing 22 of the receptacle R. 25A can be rotated out of the way into locking member chamber 15.

Figure 3:
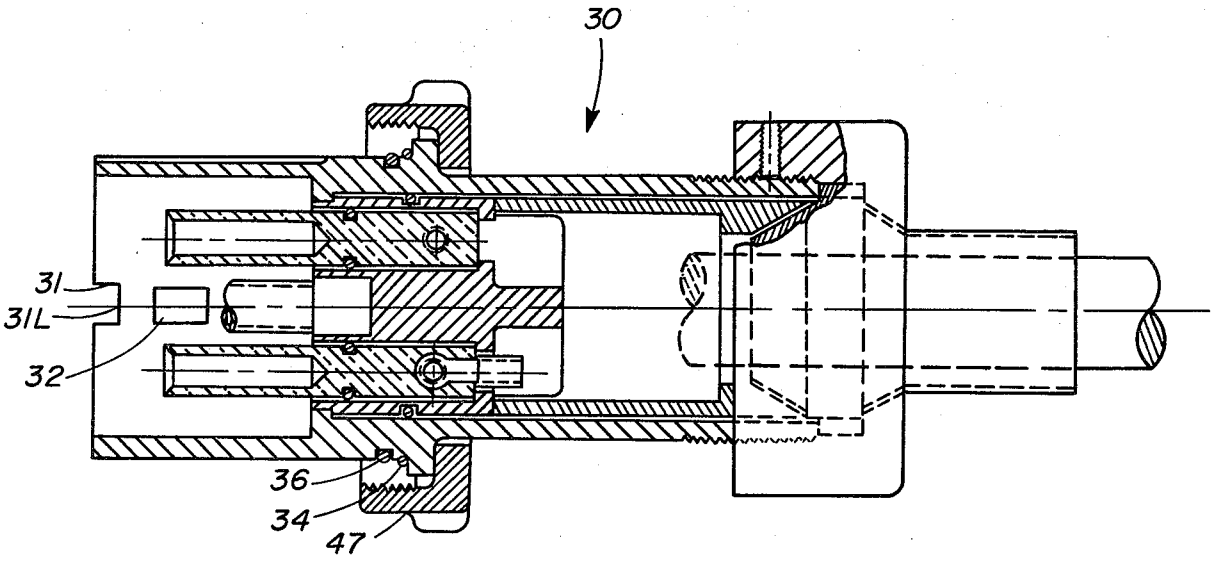
FIG. 3 is a fragmentary, side view, partly in section, of a plug of the type generally used in combination with the receptacle of the present invention.

The electrical contacts are housed within the second housing 22 and can be connected to the circuit breaker 10 by means of conductors as well known in the art, and can be either the male or female variety so as to correspond to and interact with the converse elements of the plug member 30 of FIG. 3. These contacts are provided with "O"-ring seals to preclude any moisture penetration into the adjacent circuit breaker 10 and wiring compartment.

In FIG. 1, the rotating lock member 21 is shown in the locked position and precludes the lock member 20 from movement in the direction of arrow 24, thus preventing the circuit breaker 10 from being in the on position and preventing the electrical contacts (not shown) within the receptacle R from being energized.

Due to the spring SP, the rotating lock member 21 rotates counterclockwise about the locking shaft 23 up to the point in which the latch member 25 engages the lock member 20 thus precluding further rotation. Arrow 24 indicates the direction of movement of the knob 18 to the "on" direction which causes the cam portion C of the rotating lock member 21 to nestle in a receiving notch 37 of the lock member 20 and act as a wedge between the locking shaft 23 and the shaft 16. Accordingly, the mechanism cannot be put into the "on" position and the electrical contacts housed within the first housing region 12 cannot be energized when there is no plug in the plug housing 22.

It is of critical importance that the shaft 16 rides in the seals 11 and 13, which can conveniently be of the "O"-ring variety, in order to secure the watertightness of the safety locking housing H.

The interior of the receptacle R is additionally sealed against the environment during non-use of the receptacle R, by means of a gasket 45 of an end cap 19 which threadedly engages external end threads 27 of the outer housing 14. The end cap 19 is screwed into place to protect the watertight integrity of the receptacle R when the electrical plug 30 is not in place in the receptacle R. However, it will be noted that the design of the seals and gaskets precludes the entrance of water into the circuit breaker even with the end cap 19 open.

Figure 2:
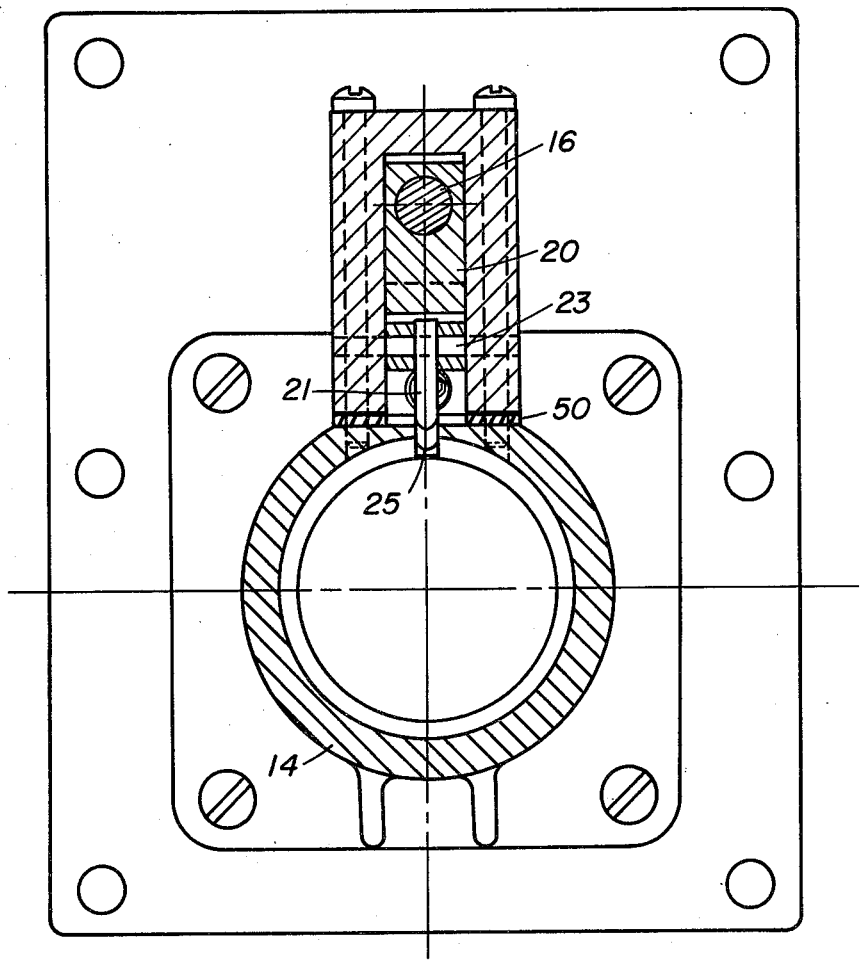
FIG. 2 is a cross-sectional view, taken along line 2—2, of FIG. 1.

FIG. 2 which illustrates a cross section view of the receptacle without the plug 30 of FIG. 3, shows the rotating lock member 21 with the latch portion 25 of the rotating lock member 21 extending into the open region of the plug housing 22 of the receptacle R in such a manner as to be able to engage with the plug 30, as will become evident hereinafter.

FIG. 3 illustrates the plug member 30 in accordance with the present invention and shows the operating notch 31 which engages the rotating latch portion 25 and the interlocking key hole 32 which engages the latch member 25A. Insertion of the plug 30 into the receptacle plug housing 22 causes the operating notch 31 to engage the latch portion 25 and force the rotating lock member 21 to move against the action of the spring SP and rotate clockwise about the locking shaft 23.

Upon engagement of the latch portion 25 in the operating notch 31 and the latch member 25 in the interlocking key hole 32, the rotating lock member 21 is out of the way of the lock member 20, thus the knob 18 can be moved in the direction of arrow 24 of FIG. 1 moving the on-off circuit breaker 10A to the "on" position of the switch 10.

Conversely the return movement of the knob 18 with the lock member 20 in the direction opposite that of the arrow 24, permits the rotating lock member 21 to be spring rotated counterclockwise while the plug 30 is withdrawing from the receptacle R. Obviously, and critically, the plug 30 cannot be removed from the receptacle until the knob 18 is moved to the extreme off position since the latch portion 25A is engaged in the interlock key hole 32 of the plug 30.

While in place, the plug 30 seals of the safety lock housing H and the interior of the receptacle R against entrance of moisture, by virtue of the engagement of the inner edges of the outer extremity of the plug housing 22 portion of the receptacle R with "O"-ring 36. Compression of the "O"-ring 34 is achieved by threadedly engaging the collar 47 onto the plug housing 22 portion of the receptacle R.

It can thus be seen that the pair of "O"-rings 34 and 36 provide a seal between the plug 30 and the receptacle R. Watertight seals are also achieved by the "O"-rings 11 and 13 between the shaft 16 and the safety lock housing H and the watertight gaskets 50 and 52 provide the critical seals between the safety lock housing H and the watertight housing WTH for the circuit breaker 10. The gasker 54 provides a seal between the outer housing 14 and the watertight housing WTH.

The locking action described in U.S. Pat. No. 2,015,543, in so far as the projections 63 and 64, of the member 40 and the notch 60 and slot 61 are concerned, are further illustrative of the present invention.

The criticality of the design of the instant invention over the prior art becomes apparent upon further comparison with patents such as U.S. Pat. No. 2,015,543 in that it should be apparent that the switch activation mechanism of the patent, inclusive of elements 14, 30, 34, 36, 41 and 44, do not lend themselves to cooperation with fluid tight seals an consequently cannot be converted from explosion proof to waterproof usage.

The structure of the present invention is seen to provide a completely watertight enclosure, prevent the insertion or removal of a plug when the switch is in the "on" position, and to require few parts. The only moving parts are the circuit breaker activating arm, its linkage members and the lock member 20 and the rotating lock member 21.

Experience has shown that there is a tendency to fail to use or adequately tighten the locking ring 59 and as previously noted, the instant invention overcomes the problem by holding the plug rigidly in place as long as the assembly is in the ON position by the rotating cam member while the "O"-ring 36 maintains a seal with the receptacle 14.

It is thus seen that the locking mechanism serves both as an electrical safety device and to protect the watertight integrity of the plug-receptacle assembly.

The dimensions of the device are not narrowly critical except to the extent that it is essential that the locking mechanism not only prevent the circuit breaker from being placed in the ON position without the plug in place, but also that the plug be locked to the receptacle in a watertight manner.

Figure 5A:
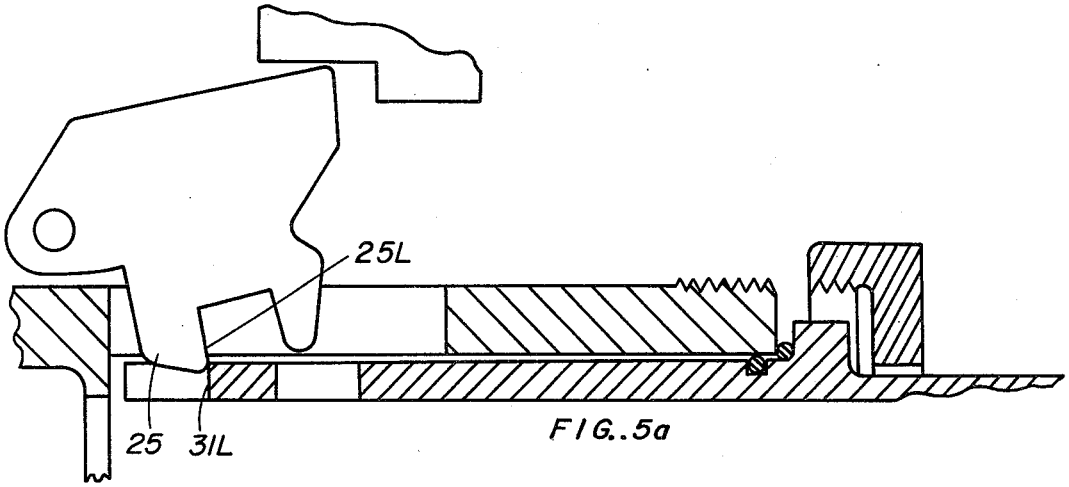
FIGS. 5A, 5B, and 5C are fragmentary sequential views showing in cross-section the insertion of a plug and the rotation of the rotating lock member into engagement with the plug.
Figure 5B:
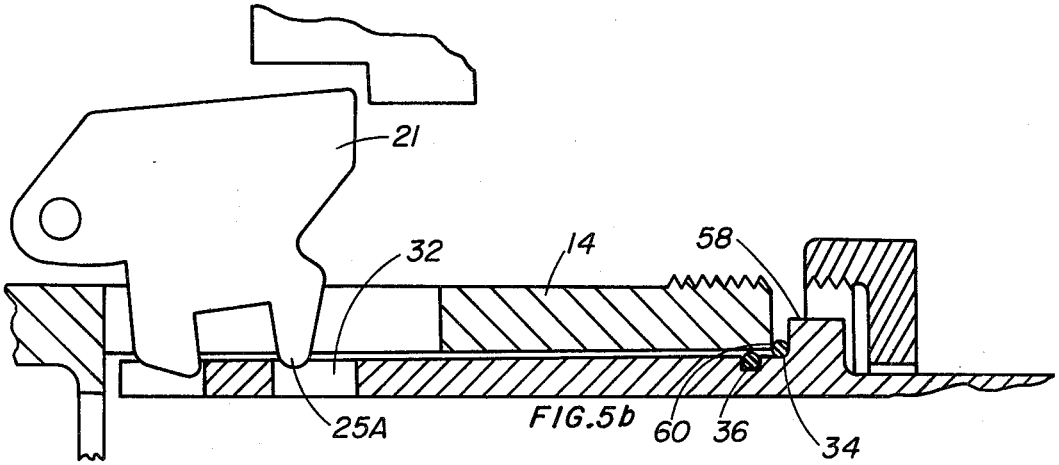
Figure 5C:
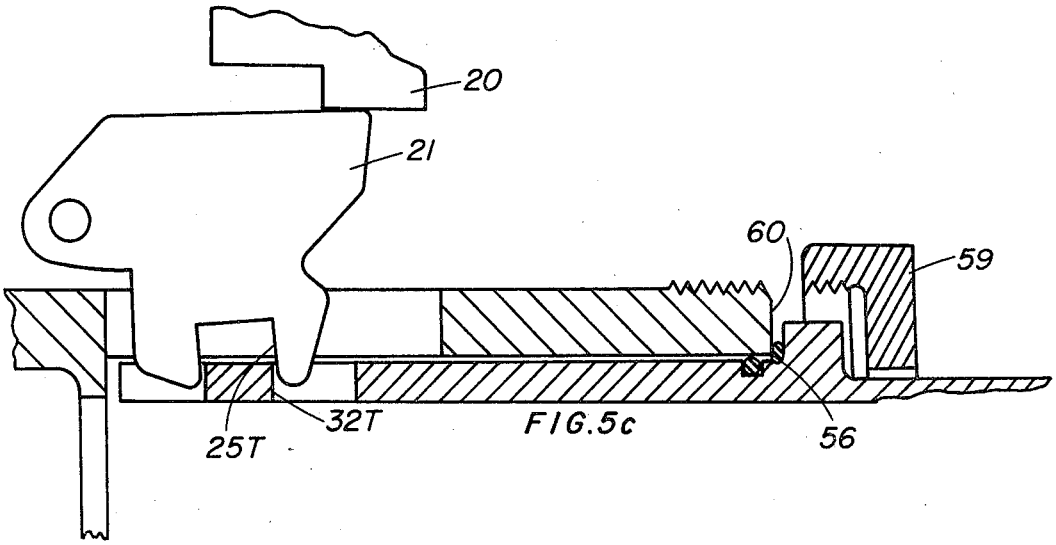

The function of the locking mechanism with respect to the O-ring 34 and the achieving of a watertight seal can best be seen by following the insertion sequence for the plug 30 as seen in FIGS. 5*a*, 5*b* and 5*c*.

In preparation for insertion of the plug, the end cap 19 is removed and the plug 30 is inserted. As seen in FIG. 5*a*, the leading edge 31L of the operating notch 31 initially engages the leading edge 25L of the latch member 25 causing rotation of the rotating lock member 21 about the locking shaft 23.

As seen in FIG. 5*b*, the rotation continues until the latch portion 25A, of the rotating lock member 21 being to enter the plug interlocking key hole 32. It is noted that at this point, the lock member cannot yet move to the ON position and O-ring 34 is not under compression.

Figure 4:
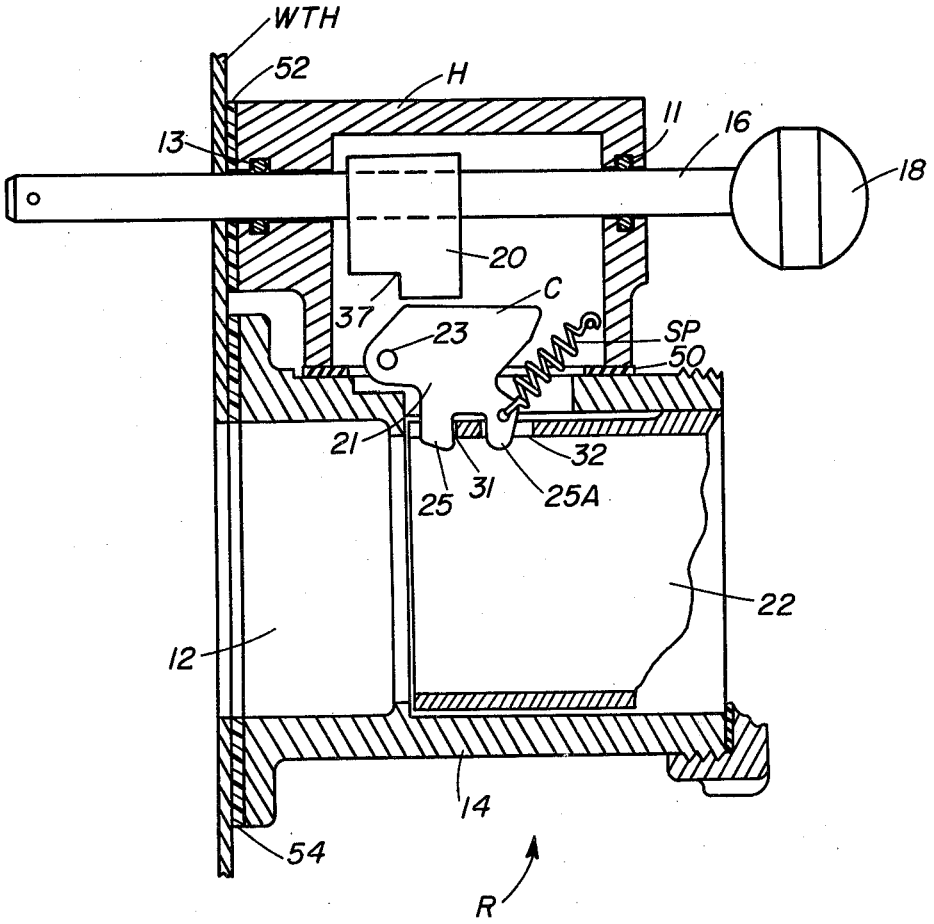
FIG. 4 is a fragmentary side view, partly in section, of the embodiment of FIGS. 1 and 3, in combination.

As seen in FIG. 5*c*, the rotating lock member 21, has rotated out of the path of the lock member 20 and the O-ring 36 is under compression between the O-ring seat 56 of the flange portion 58, of the plug 30 and the inner edge 60 of the outer housing 14. As evident from FIG. 4, rotation of the rotating lock member 21 is precluded as long as the lock member 20 is in the ON position. Looking once again to FIG. 5C, it is seen that trailing edge 32T is in engagement with the trailing edge 25T, of the latch portion 25A. Further movement of the plug 30 toward the retracted position is precluded as long as the lock member 20 is in the position of FIG. 4. Thus, the O-ring 36 remains under compression, whether or not the rotating locking ring 59 is employed.

While the drawings are not intended to be to scale, it should be evident that for the rotating lock member 21 to lock the O-ring 34 under compression, the difference in the distance from the trailing surface 25T of the finger-like latch portion 25A to the outer edge 60 of the outer housing 14 and the distance from the trailing edge 32T of the operating key hole 32 must be less than the thickness of the O-ring.

What is claimed is:

1. In a waterproof device having means for opening and closing an electrical circuit and an electrical receptacle for receiving an electrical plug, the improvement which comprises:

a watertight housing, said watertight housing having a first passage means and a second passage means;

electrical means for opening and closing an electric circuit, said electrical means being contained within said watertight housing;

plug means, said first passage means providing communication between said watertight housing and said plug means;

first waterproof means for providing a waterproof seal between said plug means and said watertight housing means;

electrical connection means for electrically connecting said plug means and said electrical circuit;

safety lock housing, said second passage means providing communication between said electrical means and said safety lock housing;

first shaft means, said first shaft means extending from said watertight housing through said second passage means into said safety lock housing and through a third passage means to the exterior of said safety lock housing;

a rotating lock member, said rotating lock member being positioned in said safety lock housing and biased for rotation about a second shaft, lock means afixed to said first shaft and capable of movement from a first position to a second position, said first position being open and said second position corresponding to said circuit being closed, said first shaft including connecting means, for connecting said first shaft to said electrical means and causing said electrical means to open and close said electrical circuit;

a plug receiving region, said region being positioned such that a first portion of said rotating lock member extends into said plug receiving region, in the path of the plug during insertion into said plug receiving region, the insertion of said plug causing said rotating lock member to rotate;

said rotating lock member having a second portion positioned between said first position and said second position of said lock means when in its biased position;

said lock means being positioned when in its second position, such that said rotating lock member is precluded from rotating to its biased position;

interlocking means, interlocking said rotating lock and said plug when said plug is in engagement with said plug means, said interlocking means preventing withdrawal of said plug when said rotating lock member is not in its biased position;

whereby, said plug cannot be moved until the shaft is moved such that said electrical circuit is open and said rotating lock member can be rotated to its biased position and said plug cannot be inserted unless rotating lock member is in its biased position.

2. The waterproof device of claim 1, wherein said rotating lock member is spring biased for movement about said shaft.

3. The waterproof device of claim 1, wherein said watertight housing is separated from said safety lock housing by a watertight gasket.

4. The waterproof device of claim 1, wherein said plug receiving means is separated from said watertight housing by a watertight gasket.

5. The waterproof device of claim 1, further comprising an "O"-ring positioned in said second passage between said shaft and said safety lock housing.

6. The waterproof device of claim 1, further comprising an "O"-ring positioned in said first passage between said shaft and said safety lock housing.

7. The waterproof device of claim 1, wherein said lock means is rigidly fixed to said shaft and carried by said shaft for movement into and out of the path of rotation of said rotating lock member.

8. The waterproof device of claim 1, wherein said rotating lock member includes a pair of fingers and said plug has a forward region for engagement with one of said pair of fingers and a recess for engagement with the second of said pair of fingers, whereby upon insertion of said plug into said plug receiving region, said forward region engages said one of said pair of fingers and causes rotation of said second of said pair of fingers into said recess.

9. The waterproof device of claim 8 wherein said plug includes a circumferential flange region and said plug receiving region includes a circumferential outer edge, said plug and said plug receiving region being dimensioned and positioned such that when said second of said pair of fingers is in said recess said flange region is proximate said outer edge.

10. The waterproof device of claim 9, wherein said plug includes a waterproof seal means proximate said flange and when said second of said pair of fingers is locked in place in said recess said waterproof seal means is held under compression between said flange and said outer edge.

11. The waterproof device of claim 10, wherein said waterproof means is an O-ring.

* * * * *